US005678438A

United States Patent [19]

Kolkman et al.

[11] Patent Number: 5,678,438

[45] Date of Patent: Oct. 21, 1997

[54] CABINET LOCK CONSTRUCTION CONVERTIBLE BETWEEN A DRAWER LOCK AND A DOORLOCK

[76] Inventors: Donald J. Kolkman, Rte. 10, 211 Oakwood Ct., Greenville, S.C. 29607; William H. Cliff, 921 Fargo St., Mauldin, S.C. 29662

[21] Appl. No.: 482,890

[22] Filed: Jun. 7, 1995

[51] Int. Cl.[6] ..... E05B 9/08

[52] U.S. Cl. ..... 70/370; 70/371; 70/374

[58] Field of Search ..... 70/367, 370, 371, 70/373, 374, 448, 451, 461

[56] References Cited

U.S. PATENT DOCUMENTS

| | | | |
|---|---|---|---|
| 1,561,254 | 11/1925 | Ledin | 70/370 |
| 1,714,424 | 5/1929 | Jacobi | 70/373 |
| 2,244,976 | 6/1941 | Tinnerman | 70/370 |
| 2,717,512 | 9/1955 | Sterling | 70/370 |
| 3,358,483 | 12/1967 | Wellekens | 70/370 |
| 3,589,152 | 6/1971 | Glass | 70/371 |
| 3,733,865 | 5/1973 | Vorob | 70/370 |
| 3,824,817 | 7/1974 | Orr | 70/371 |
| 4,697,444 | 10/1987 | Maffey | 70/371 |
| 4,756,638 | 7/1988 | Neyret | 70/451 |
| 4,899,563 | 2/1990 | Martin | 70/371 |
| 4,951,980 | 8/1990 | Wetzel | 70/451 |

*Primary Examiner*—Steven N. Meyers
*Assistant Examiner*—Gary Estremsky
*Attorney, Agent, or Firm*—Banner & Witcoff, Ltd.

[57] ABSTRACT

A cabinet lock is disclosed which is easily convertible between a drawer lock and a door lock, by rotating the lock cylinder 90 degrees within the lock body. The cabinet lock includes a lock body with a mounting plate and an extending sleeve that defines a central opening. A portion of the sleeve is indented inward to form a two-sided right angle notch that projects into the internal cavity of the sleeve, with an aperture through each side of the notch. The lock cylinder has first and second notch mating sections, rotated 90 degrees from one another about the cylinder, each having a threaded bore therein. The lock cylinder can be inserted into the sleeve in a first position, or in a second position rotated 90 degrees from the first position, and fixed in place with a screw that passes through one of the bores and one of the apertures. A lock plug with a bolt driving mechanism is adapted to fit within a longitudinal opening in the lock cylinder, and a bolt is operatively attached to the bolt driving mechanism.

6 Claims, 4 Drawing Sheets

FIG.1
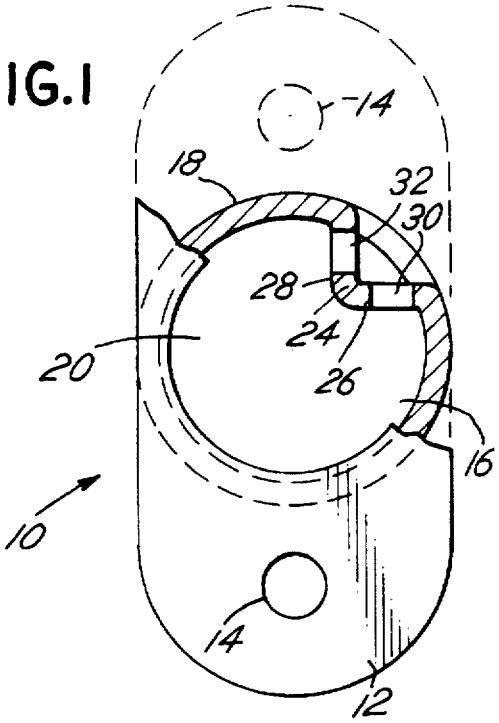
FIG.2
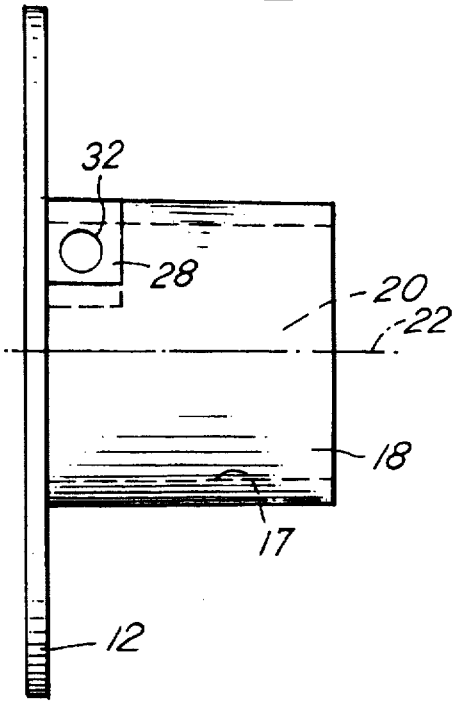
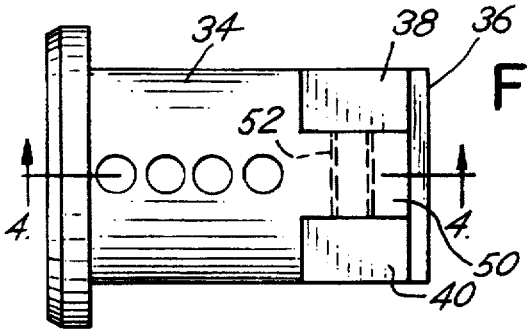
FIG.3
FIG.4
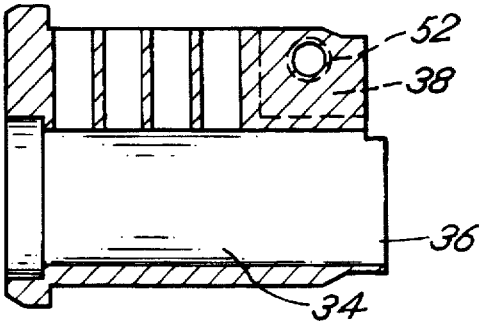
FIG.5
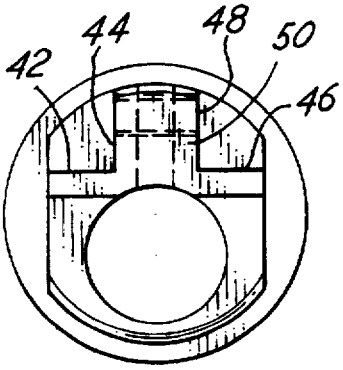

FIG. 8
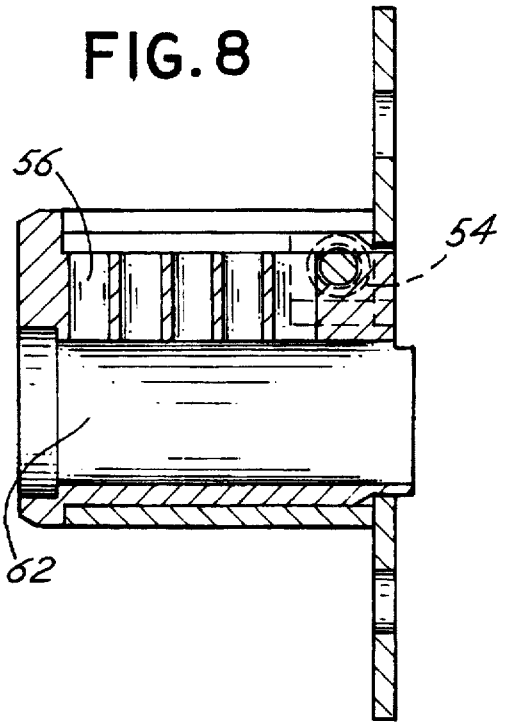
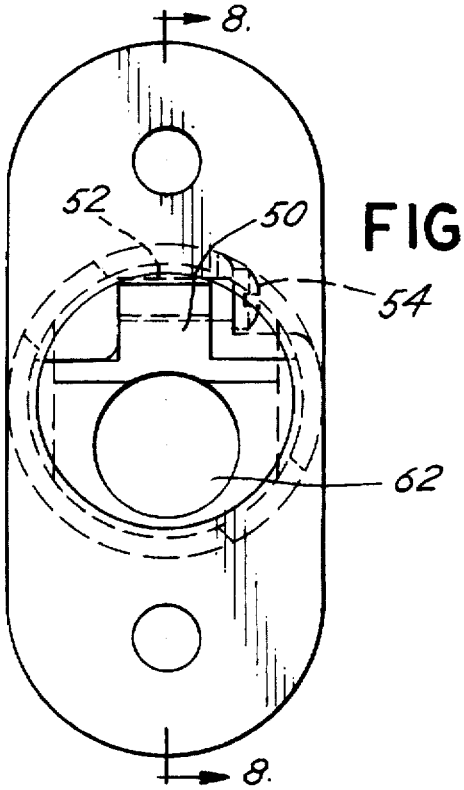
FIG. 6
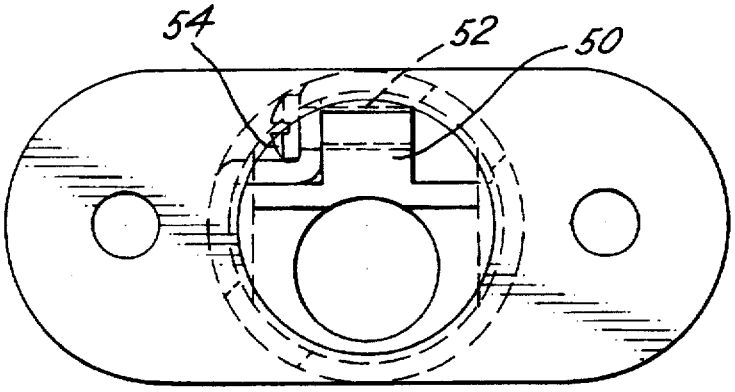
FIG. 7
FIG. 9
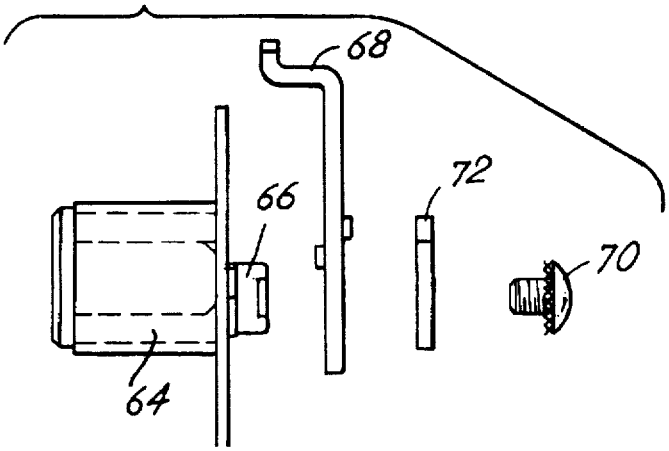

68
70
85
82
54
14
86
16
87
14
34
78
34a
64
34b
35
85
14
86
84
16
14
87

CABINET LOCK CONSTRUCTION CONVERTIBLE BETWEEN A DRAWER LOCK AND A DOORLOCK

BACKGROUND OF THE INVENTION

1. Field of the Invention

This invention relates to the field of cabinet locks typically used in desk file cabinets, credenzas and the like. More specifically, the present invention relates to cam locks that can be converted between a door lock structure and a drawer lock structure.

2. Description of the Prior Art

Cabinet locks come in two basic types, door locks and drawer locks. The principal difference between these locks is the direction in which the bolt moves. In door locks, the bolt typically moves horizontally from the edge of a door into engagement with a strike mounted on a door jamb. In drawer locks, the bolt typically moves vertically from the edge of a drawer into engagement with a strike mounted on a cabinet.

In either case, it is generally preferred to have the keyway of the lock oriented vertically. As a result, it is not commercially practical to use a drawer lock in the place of a door lock, or vice versa, since that would result in a horizontal keyway, which is not a commercially practical situation. Therefore, lock manufacturers have historically manufactured separate lock designs for door locks and drawer locks, which are basically identical except with regard to the position of the keyway with respect to the direction of the bolt action.

Recently, however, lock manufacturers have attempted, for manufacturing purposes, to create a convertible lock in which a single device can be converted from a door lock to a drawer lock, using the same parts. One such structure is the Olympus 721 IC, marketed by the Olympus Lock Company. The Olympus lock has two holes in the extending cylinder of the lock body positioned 90 degrees from each other. The lock cylinder has a threaded bore which can be aligned with either of these holes. When the bore is aligned with one hole, the lock is in the position of a door lock. When it is aligned with the other hole, it is in the position of a drawer lock. However, the Olympus lock construction has several drawbacks. Most significantly, it requires a separate cam driving mechanism for each particular lock construction. Therefore, the conversion requires not only a change in the orientation of the lock cylinder but also replacement of the cam driver. In addition, the prior art is limited to square back locks and does not encompass the construction used in conjunction with cam locks.

Therefore, there remains a need for a simple construction that allows the conversion of not only cam locks but also square back locks and cabinet locks between drawer lock constructions and door lock constructions.

It is thus an object of the present invention to provide a cabinet lock assembly that can be easily converted between operation as a drawer lock or a door lock.

A further object of the present invention is to provide a convertible cabinet lock mechanism that can be used with various different types of locks, including cam locks, square back locks, pin tumbler locks and disc tumbler locks.

Still a further object of the present invention is to provide a convertible cabinet lock that is easy to manufacture, based on the modification or adaptation of preexisting designs for non-convertible locks.

These and a number of additional objects are provided by the present invention.

SUMMARY OF THE INVENTION

In a basic aspect, the present invention is a cabinet lock that is convertible between a drawer lock and a door lock. The cabinet lock includes a lock body that includes a mounting plate with a central opening, and a tubular sleeve that extends perpendicularly from the mounting plate. The sleeve defines an open-ended internal cavity, which is aligned with the central opening of the mounting plate.

A lock cylinder fits within the cavity of the sleeve, and can be rotated between a first position in the sleeve, and a second position, 90 degrees from the first. The first position may correspond to the door lock configuration, while the second position corresponds to the drawer lock configuration. The lock cylinder includes one or more threaded bores therein, which align with one or more corresponding apertures on the lock body when the lock cylinder is in either the first or second position.

The assembly further comprises a locking screw, capable of associating with an aligned aperture and threaded bore, to lock the lock cylinder into position within the sleeve in either the first or second position. A lock plug with a bolt driving mechanism is adapted to fit within a longitudinal opening in the lock cylinder, and a bolt is operatively attached to the bolt driving mechanism.

In one embodiment of the present invention, the lock body has two apertures located thereon, positioned 90 degrees from each other. Preferably, these apertures are located in a right angle notch that projects from the inner surface of the sleeve into the internal cavity, with one aperture on each side of the right angle notch. In another embodiment, the apertures are located on the mounting plate. One of the two apertures aligns with a threaded bore on the lock cylinder when the cylinder is in a first position, and the other aperture aligns with a threaded bore on the lock cylinder when the cylinder is in a second position, 90 degrees from the first position. A locking screw is then provided which passes through the aperture and into the threaded bore to lock the lock cylinder in place.

In another embodiment of the invention, the lock body has only one aperture, preferably in the mounting plate, and there are two threaded bores in the lock cylinder, 90 degrees apart. In this embodiment, it is the rotation of the lock cylinder that allows one or the other bore to line up with the aperture.

The present invention provides a cabinet lock assembly that can be easily converted between operation as a drawer lock or a door lock. In addition, the convertible cabinet lock mechanism disclosed herein can be used with various different types of locks, including cam locks, square back locks, pin tumbler locks and disc tumbler locks. Moreover, since the lock assembly is based on traditional lock designs, it can be easily manufactured by modifying production techniques used for preexisting non-convertible locks.

BRIEF DESCRIPTION OF THE DRAWINGS

FIG. 1 of the drawing is a front view of a lock body used in a preferred embodiment of the present invention, with a portion of the mounting flange removed.

FIG. 2 of the drawing is a right-hand view of the lock body shown in FIG. 1.

FIG. 3 of the drawing is a top view of a lock cylinder adapted for use with the lock body of FIGS. 1–2.

FIG. 4 of the drawing is a right hand cross-section view of the lock cylinder shown in FIG. 3, taken along the line 4—4 of FIG. 3.

FIG. 5 of the drawing is a front view of the lock cylinder shown in FIGS. 3 and 4.

FIG. 6 of the drawing is a rear view of a lock assembly, showing a cylinder lock installed within a lock body in a vertical orientation, suitable for use in a door.

FIG. 7 of the drawing is a rear view of the lock assembly of FIG. 6, showing the cylinder lock installed within the lock body in a horizontal orientation, suitable for use in a drawer.

FIG. 8 of the drawing is a right hand cross-section view of the lock assembly shown in FIG. 6, taken along line 8—8 of FIG. 6.

FIG. 9 of the drawing is an exploded right hand view of a lock assembly, showing various components thereof.

DETAILED DESCRIPTION OF THE PREFERRED EMBODIMENT

Figure 10:
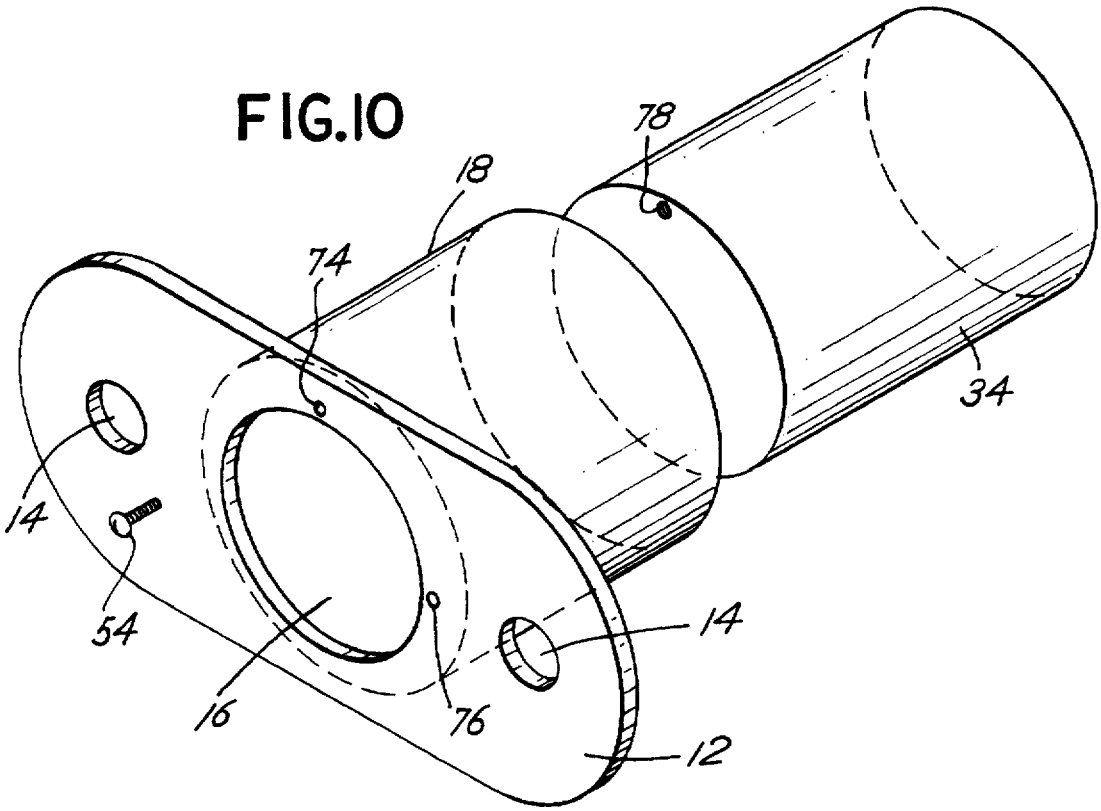
FIG. 10 of the drawing is an exploded perspective view of an alternate embodiment of the present invention, showing the cooperation of the threaded bore in the lock cylinder with corresponding apertures in the mounting plate.

FIGS. 1–10 illustrate various details of a first preferred embodiment of the present invention, in particular a back-mount cam lock incorporating the conversion feature of the present invention. Turning first to FIGS. 1 and 2, details of the lock body 10 are shown. The lock body 10 includes a mounting plate 12 adapted to be mounted onto a cabinet (not shown). The mounting plate 12 includes two holes 14 located generally at its respective ends. These holes receive a mounting device such as a screw (not shown) to secure the lock 10 to the cabinet. The mounting plate also defines a central opening 16.

An extending sleeve 18 is attached to the mounting plate. The extending sleeve 18 is positioned substantially perpendicular to the mounting plate 12. This attachment can be by any appropriate means such as welding, brazing, a press fit or other mechanical connection. One end (referred to herein as the proximal end) of the extending sleeve 18 is positioned over the central opening 16 of the mounting plate 12. The interior surface 17 of the extending sleeve 18 defines an interior cavity 20 within the sleeve 18, having a longitudinal axis 22 passing substantially through the center of the cavity 20 and through the central opening 16 of the mounting plate 12. In the preferred embodiment the cavity 20 is substantially cylindrical in cross section, however, other appropriate configurations may be employed.

Near the proximal end of the extending sleeve 18, a portion of the sleeve 18 is indented inward to form a notch 24, which projects into the interior cavity 20. The notch 24 comprises a first side 26 and a second side 28, each of which pends from the interior surface 17 of the sleeve 18 and extends into the cavity, parallel to the longitudinal axis, where they meet to form approximately a right angle. A first aperture 30 is defined in the first side 26 of the notch 24, and a second aperture 32 is defined in the second side 28 of the notch 24. Each of the apertures 30 and 32 are located substantially centrally in the respective side of the notch 24. The notch 24 should extend into that cavity 20 a distance less that half of the diameter of the cavity, and preferably a distance about one-third the diameter of the cavity.

The side walls 26 and 28 of the notch 24 should be preferably be about ¼ inch wide, measured along the longitudinal axis 22. The apertures 30 and 32 should also be readily accessible from the outer surface of the sleeve, to allow a screw to be easily introduced into the aperture from outside the sleeve 18.

Turning to FIGS. 3–5, the details of a lock cylinder 34 adapted to fit within the cavity 20 of the above-described lock body 10 are shown. The lock cylinder 34 is generally a standard lock cylinder, the proximal end (the end nearest the mounting plate 12) of which has been altered to mate with the notch 24 in the sleeve 18. When the lock cylinder 34 is introduced into the sleeve 18, the proximal end 36 of the lock 34 is directed towards the mounting plate 12. The proximal end 36 of the lock cylinder 34 includes two notch-mating sections 38 and 40. The first notch mating section 38 has first and second flat surfaces, 42 and 44, sized to mate with the inner sides of the notch 24. Similarly, the second notch mating section 40 has first and second flat surfaces 46 and 48 sized to mate with the inner surface of the notch 24. The respective first flat surfaces 42 and 46 are positioned substantially along the same line with respect to on another. The second flat surfaces 44 and 48 of the respective notch mating sections are parallel to one another and define a wall 50 between them.

Each of the second flat surfaces 44 and 48 includes a threaded bore 52 positioned to align with the apertures in the sides of the notch 24. As illustrated in FIGS. 3–5, the threaded bores 52 are preferably a single bore passing completely through the wall 50 and through the respective second flat surfaces 44 and 48.

Turning to FIGS. 6–8, when the cylinder 34 is inserted into the extending sleeve 18 one of the notch mating sections 38 or 40 will align with the notch 24, and the threaded aperture 52 will align with one of the apertures 30 or 32 in the notch 24. A locking screw 54 can then pass through the aperture 30 or 32 into the threaded bore 52, to fix the cylinder in place. If it is desirable to rotate the cylinder 90° to convert the lock from a door lock to a drawer lock, or vice versa, the screw 54 is removed, and the cylinder is rotated 90°, so that the other notch mating section aligns with the notch. In this configuration the other aperture will align with the other threaded bore and the locking screw can be inserted to fix the cylinder in the second position. FIGS. 7 and 8 show the lock cylinder in two different positions, rotated 90 degrees in each case. Thus, the configuration shown in FIG. 7, in which the mounting flange is oriented vertically, would be proper for use in a door. The configuration shown in FIG. 8, with the mounting flange positioned horizontally, would be proper for use in a drawer.

While the present invention is particularly preferred in pin tumbler locks it may also be employed with disc tumbler locks. As shown in FIG. 8, in the pin tumbler embodiment the lock cylinder 34 defines a series of pin containing chambers 56 which receive pins (not shown) and springs (not shown). The lock cylinder 34 further defines a plug receiving passage 62, which is aligned with the central opening 16 in the mounting plate 12. Turning to FIG. 9, a lock plug 64 is adapted to fit within the plug receiving passage 62, and operate with the cylinder 34 in a manner well known in the art. The inner end of the plug 64 is associated with the lock bolt or cam 68. In the preferred embodiment, the lock bolt 68 is attached to the lock plug 64 by means of a bolt screw 70. The bolt screw 70 secures the lock bolt 68 to the lock plug 64, and secures a shifter 72 to the bolt. The shifter 72 controls the range of movement of the bolt 68 in a manner well known in the art.

Thus, to convert the lock between a door lock and a drawer lock the following steps must be performed. First, the lock screw 54 and the bolt screw 70 are removed. Second, the lock cylinder 34 is withdrawn from the sleeve 18 and rotated 90°. Third, the lock cylinder 34 is reinserted into the sleeve 18 in the new position. The lock screw 54 is reinserted into the aperture 30 or 32 and the corresponding threaded bore 52. The lock bolt 68 is then reattached with the bolt screw 70. In this manner a single lock can be converted and used either as a door lock or a drawer lock.

A second embodiment of the present invention is illustrated in FIG. 10. In this embodiment, rather than using the notch construction discussed above, the locking screw 54 is attached to the lock cylinder 34 through the mounting plate 12. Specifically, referring to FIG. 10, the mounting plate includes a first aperture 74 and a second aperture 76 positioned 90° from one another about the central opening 16. The extending sleeve 18 preferably does not include any notch, and the lock cylinder 34 does not include any notch mating section. Rather, the proximal end of the lock cylinder 34 includes a longitudinal threaded bore 78, positioned to selectively align with the first aperture 74 when the cylinder 34 is in a first position within the sleeve 18, and to selectively align with the second aperture 76 when the cylinder 34 is in a second position, rotated 90 degrees from the first position. A locking screw 54 passes through either the first aperture 74 or the second aperture 76, and into the threaded bore 78. Depending upon which aperture 74 or 76 the bore 78 is aligned with the lock will be in either a door lock configuration or a drawer lock configuration. The bolt 68 is attached to the plug in the manner discussed above.

Figure 11:
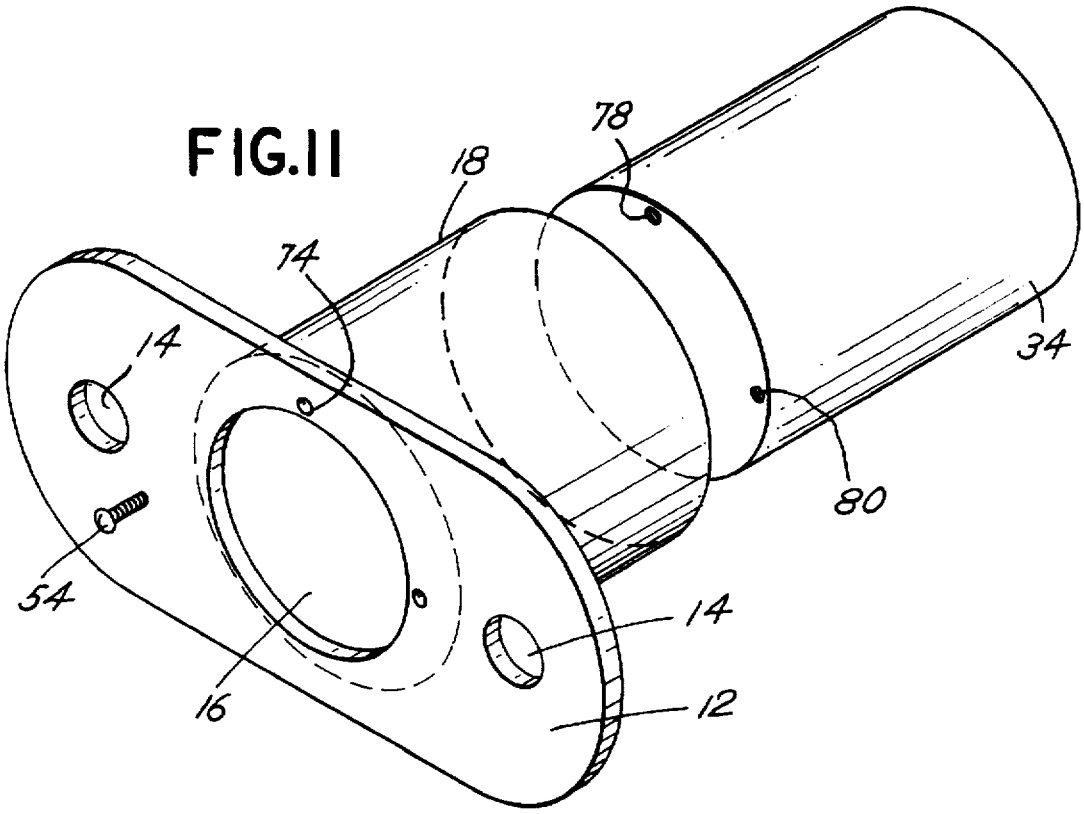
FIG. 11 of the drawing is an exploded perspective view of an alternate embodiment of the present invention, showing the cooperation of threaded bores in the lock cylinder with a single aperture in the mounting plate.

Turning to FIG. 11, a further modification of the present invention includes a lock of substantially the same construction as shown in FIG. 10. However, instead of having two apertures in the mounting plate 12 and one threaded bore in the lock cylinder 34, there is a single aperture 74 through the mounting plate and two longitudinal threaded bores 78 and 80 in the lock cylinder 34. These two longitudinal threaded bores are positioned 90° from one another as measured about the longitudinal axis of the lock cylinder 34. Therefore, the lock can be set in either a door lock configuration or a drawer lock configuration, depending upon which threaded bore 78 or 80 aligns with the single aperture 74 in the mounting plate 12.

Figure 12:
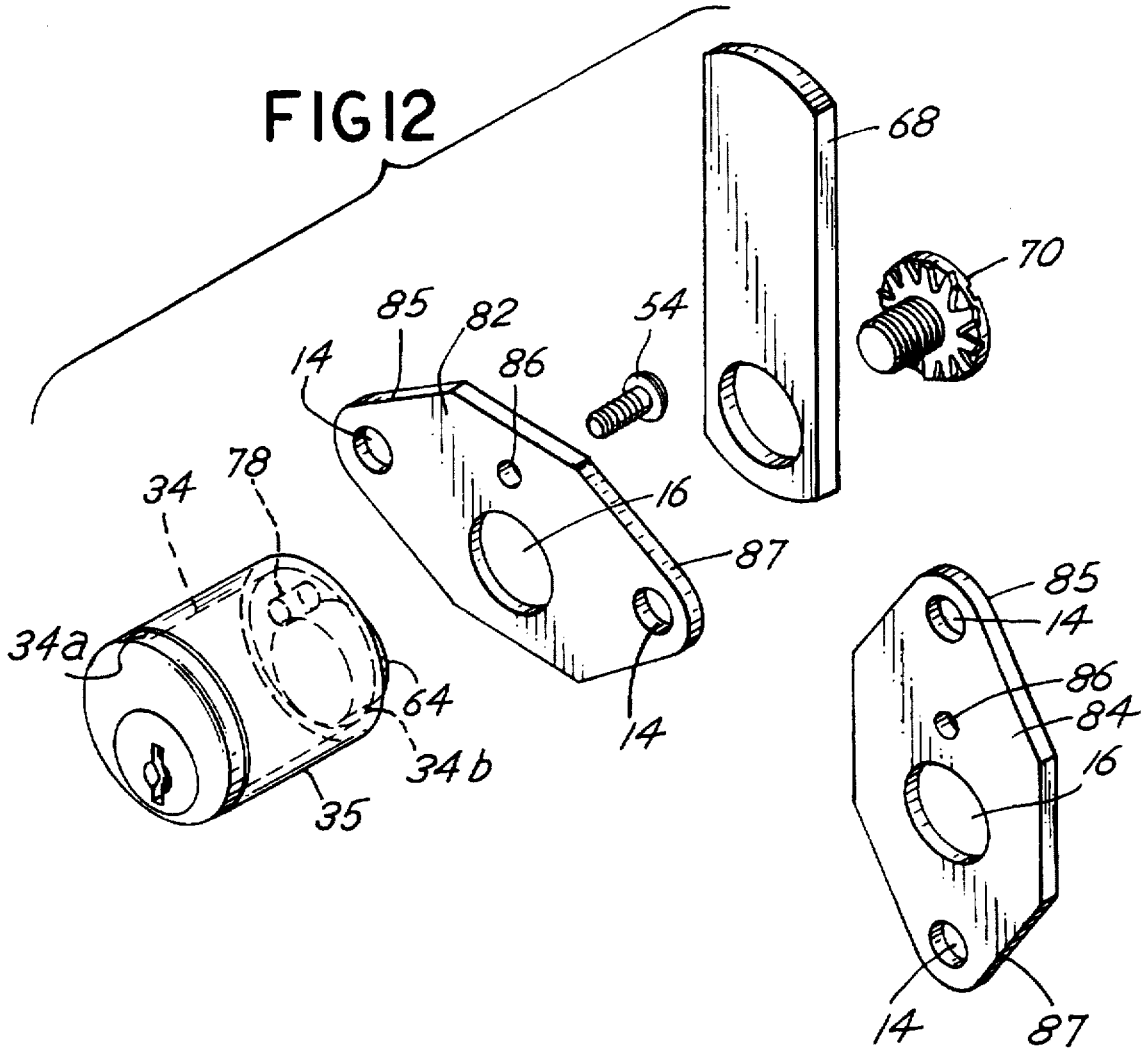
FIG. 12 of the drawing is an exploded view of another alternative embodiment, in which a lock cylinder is attached directly to either of two different mounting flanges.

Still another embodiment of the present invention is shown in FIG. 12. As shown in that figure, the apparatus comprises two interchangeable mounting plates; namely, a first mounting plate 84 for use when the lock is used as a door lock, and a second mounting plate 82 for use when the lock is used as a drawer lock, in combination with a lock cylinder 34 and sleeve 35. The lock cylinder 34, which may be a disc tumbler or a pin tumbler construction, includes circumferential front flange **34*a*, and a longitudinal threaded bore 78 extending axially into the backside 34*b* thereof. The first and second mounting plates 82 and 84 are low-profile mounting plates, allowing the appropriate mounting plate 82 or 84 to be mounted flush with the inner face of the cabinet material. Each mounting plate 82 or 84 has projecting side wings 85, 87, a central opening 16, two holes 14 for receiving mounting screws to mount the mounting plate 82 or 84 to the cabinet material. Each mounting plate 82 or 84 also has an aperture 86 for receiving a flat headed screw 54 flush with the surface of plate 82 or 84, which is used to fasten the lock cylinder 34 to a mounting plate 82 or 84. Note the cylindrical sleeve is held in position around the cylinder 34 by the flange 34*a* and retained by the screw 54 threaded into cylinder 34. A lock plug or driver 64 is adapted to fit within or project from the lock cylinder 34, and operate with the cylinder 34 in the manner described above with respect to FIG. 8. A lock bolt 68 is attached to the lock plug 64 by means of a bolt screw 70. The first mounting plate 84, if used, is positioned with the mounting holes 14 oriented vertically with respect to one another. The second mounting plate 82, if used, is positioned with the mounting holes 14 oriented horizontally with respect to one another. In each case, the aperture 86 is positioned on the mounting plate 82 or 84 to align with the bore 78, and the central opening 16 is positioned to align with the lock plug 64. By switching mounting plates, the apparatus can be selectively used as either a door lock or a drawer lock. The lock cylinder 34 and the related components, including the interchangeable mounting plates 82 and 84**, constitute a kit for installing a lock to a cabinet.

The foregoing examples are illustrative of various particularly preferred embodiments of the invention. However, they are not intended to limit the scope of the invention as claimed below, and it will be understood to persons of skill in the art that various modifications to these embodiments may be made without departing from the true scope and spirit of the invention that is claimed below.

What is claimed is:

1. A cabinet lock convertible between a drawer lock and a door lock comprising, in combination:

a lock body comprising a mounting plate having a central opening therein and a sleeve that defines an internal cavity having a longitudinal axis through the center of said cavity, said sleeve extending perpendicularly from the mounting plate with the internal cavity in alignment with the central opening of the mounting plate, the extending sleeve further including a notch having first and second sides that extend into the internal cavity parallel to the longitudinal axis and at right angles to one another, each of said first and second sides having an aperture therein;

a lock cylinder adapted to slidably fit within the cavity of the sleeve in either a first position or a second position rotated 90 degrees about the longitudinal axis from the first position, the lock cylinder having a first notch mating surface that engages the first side of the notch when the lock cylinder is in the first position and a second notch mating surface that engages the second side of the notch when the lock cylinder is in the second position, said first notch mating surface defining a bore that aligns with the aperture in the first side of the notch when the lock cylinder is in the first position and said second notch mating surface defining a bore that aligns with the aperture in the second side of the notch when the lock cylinder is in the second position;

a locking fastener capable of associating with the aligned aperture and the bore to lock the lock cylinder into said sleeve in either the first or second position;

a bolt driving mechanism associated with the lock cylinder; and a bolt operatively attached to said bolt driving mechanism.

2. A cabinet lock convertible between a drawer lock and a door lock comprising, in combination:

a lock body comprising a mounting plate having a central opening therein and a sleeve that defines an internal cavity having a longitudinal axis through the center of said cavity, said sleeve extending perpendicularly from the mounting plate with the internal cavity in alignment with the central opening of the mounting plate;

a lock cylinder adapted to fit within the cavity of the sleeve in either a first position or a second position rotated 90 degrees about the longitudinal axis from the first position, wherein when the lock cylinder is in the first position, a bore in the lock cylinder aligns with a corresponding aperture in the mounting plate, and when the lock cylinder is in the second position, a bore in the lock cylinder aligns with a corresponding aperture in the mounting plate, said lock cylinder further defining a longitudinal opening for receiving a lock plug;

a locking screw capable of associating with the aligned aperture and bore to lock the lock cylinder into said sleeve in either the first or second position;

a lock plug adapted to fit within the longitudinal opening of said lock cylinder and having a bolt driving mechanism; and a bolt operatively attached to said bolt driving mechanism.

3. The cabinet lock of claim 2 wherein the mounting plate has a first aperture therein which aligns with a threaded bore in the cylinder lock when the cylinder lock is in the first position, and a second bore aperture therein that aligns with the same threaded bore in the cylinder lock when the cylinder lock is in the second position.

4. The cabinet lock of claim 2 wherein the mounting plate has a single aperture that aligns with a first threaded bore in the cylinder lock when the cylinder lock is in the first position, and with a second threaded bore in the cylinder lock when the cylinder lock is in the second position.

5. The cabinet lock of claim 1, wherein the lock is a pin tumbler lock.

6. The cabinet of claim 2, wherein the lock is a pin tumbler lock.

* * * * *